US006344253B1

(12) United States Patent
Pioventini

(10) Patent No.: US 6,344,253 B1
(45) Date of Patent: Feb. 5, 2002

(54) LEAKPROOFING ARTICLE FOR BUILDING USE

(76) Inventor: Clara Pioventini, Via Todeschini, 16, I-37126 Verona (IT)

( * ) Notice: Subject to any disclaimer, the term of this patent is extended or adjusted under 35 U.S.C. 154(b) by 0 days.

(21) Appl. No.: 09/446,252

(22) PCT Filed: Mar. 19, 1998

(86) PCT No.: PCT/IT98/00063

§ 371 Date: Dec. 17, 1999

§ 102(e) Date: Dec. 17, 1999

(87) PCT Pub. No.: WO98/58134

PCT Pub. Date: Dec. 23, 1998

(30) Foreign Application Priority Data

Jun. 18, 1997 (IT) ..... VR97A0052

(51) Int. Cl.[7] ..... B32B 3/12

(52) U.S. Cl. ..... 428/73; 428/116; 52/793.1; 52/310; 52/102

(58) Field of Search ..... 428/116, 117, 428/73; 52/169.14, 408, 310, 793.1, 783.1, 102

(56) References Cited

U.S. PATENT DOCUMENTS

| | | | |
|---|---|---|---|
| 4,048,373 | A | 9/1977 | Clem |
| 4,565,468 | A | 1/1986 | Crawford |

FOREIGN PATENT DOCUMENTS

| | | | |
|---|---|---|---|
| EP | 0 555 800 | A1 | 8/1993 |
| EP | 0 567 692 | A1 | 11/1993 |
| EP | 0 719 822 | A1 | 7/1996 |

*Primary Examiner*—Deborah Jones
*Assistant Examiner*—Wendy Boss
(74) *Attorney, Agent, or Firm*—Oppenheimer, Wolff & Donnelly LLP

(57) ABSTRACT

The present invention concerns a manufactured article impervious to water, the water being rain water, water coming from a water-bearing stratum, and/or from concrete. The manufactured article of the invention may be used in building of habitations, factories, tunnels, and/or submarine structures and the like, the article comprising a leakproofing material. The manufactured article further includes a coating constituted by a film made of a material, the water-solubility of which is kept under control, the film delaying the leakproofing material hydration process for a predetermined period of time from between 1 and 30 days.

17 Claims, 2 Drawing Sheets

FIG. 3
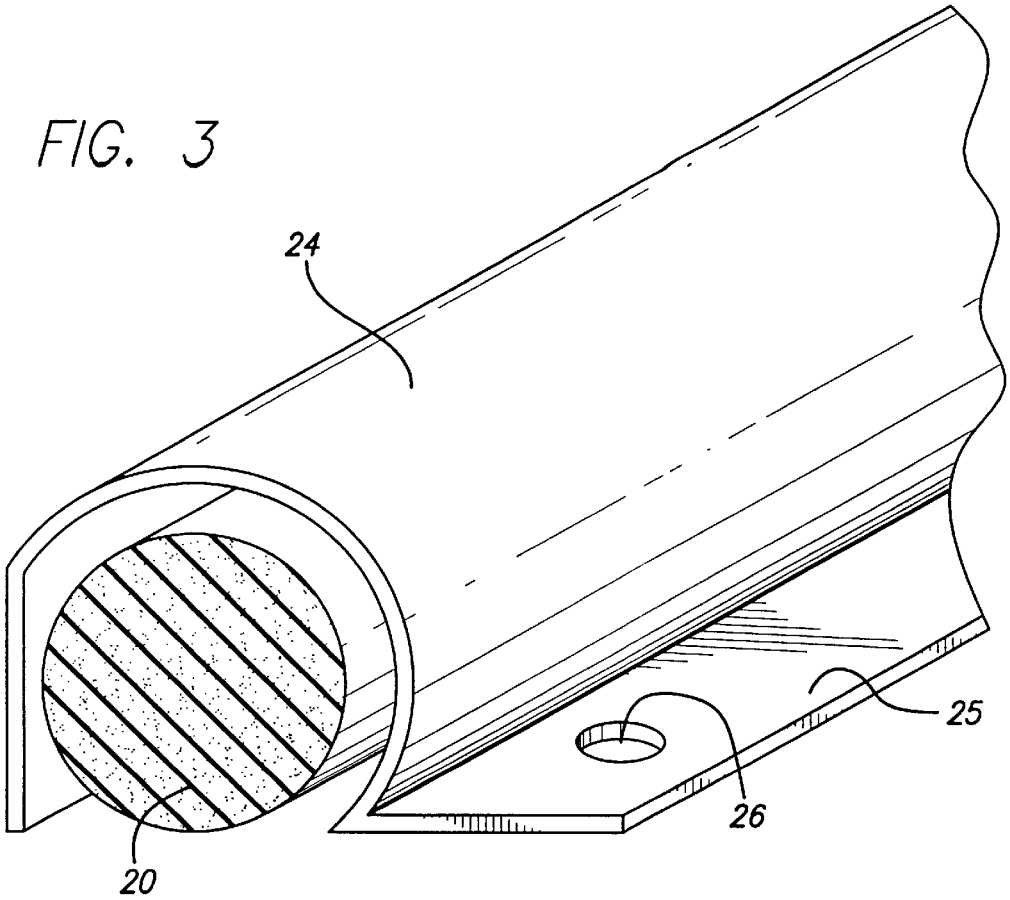
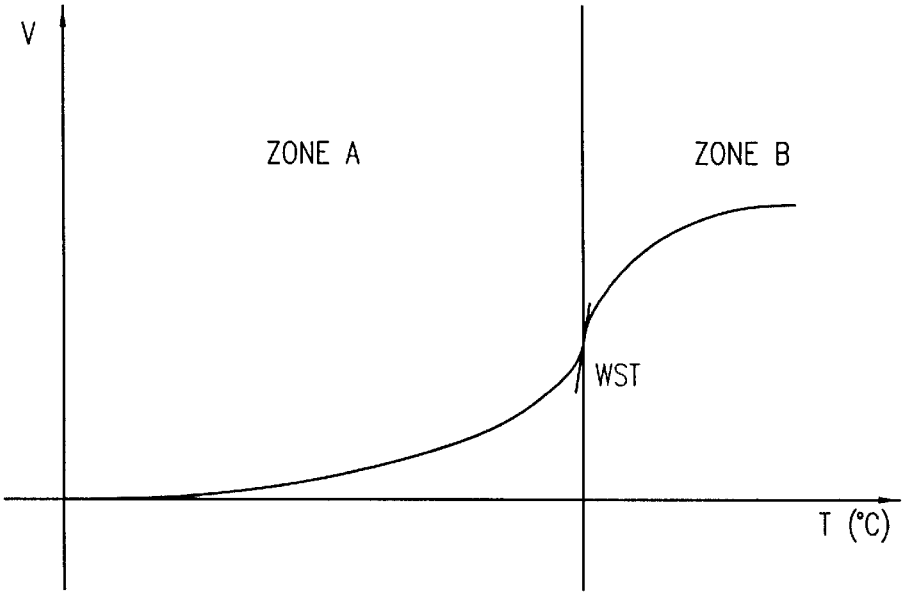
FIG. 4

LEAKPROOFING ARTICLE FOR BUILDING USE

TECHNICAL FIELD

The present invention relates to the technical field of building of habitations and/or factories, as well as of more complex building works such as building of tunnels, submarine structures and the like.

More particularly, the present invention aims to provide for a leakproofing article to be used in the building of habitation and or factory structure foundation, or for building of underground structures and/or tunnels, as well as in the more difficult technical field of submarine works.

The present invention may be mainly applied in the general technical field of building.

BACKGROUND ART

The use of bentonite as leakproofing material in the field of building is well known in the art.

For instance, it is used in the building of foundation and/or in any other type of application in which a suitable degree of imperviousness to water has to be assured.

It is also known that sodium natural bentonite is a clay which undergoes a substantial hydration when it comes into contact with water, said hydration increasing the bentonite volume up to thirty times its dry volume.

As a consequence of the hydration process, it is known that the bentonite produces both a gel phase of the colloidal type, which causes an increase of the bentonite volume of about 10–15 times with respect to its dry volume, and a solute phase, which causes an even greater increase of the bentonite volume.

Bentonite is used in the form of particles, generally placed inside of one or more layers of corrugated card-board sheets or of needled non-woven fabrics, obtaining a structure similar to a panel and/or a small mattress which is set at the extrados of underground structures foundation and/or at any other location where a leakproofing barrier is needed.

A further solution known the art provides for the use of bentonite coupled with a suitable binder, e.g. butylic rubbers and/or water-soluble glues.

In this case, the system binder/bentonite is given a rolled shape or a panel type shape to so that it can be sufficiently handy and easy to be laid.

For instance, U.S. Pat. No 4,048,373 discloses a solution of the type cited above according to which a leakproofing panel is produced, said panel being formed by two sheets, advantageously card-board sheets, suitably spaced in order to contain bentonite together with a suitable additive.

In general, said additive is constituted by a water-soluble dispersant, e.g. a water-soluble salt of acetic or phosphoric or boric acid, combined with a water-soluble polymer, for instance polyacrylic acid, water-soluble salts of polyacrylic acid, polyacrylnitril, polyvinylacetate, polyvinylalcohol or copolymer thereof, according to defined percentages of the components of the bentonitic composition.

According to a preferred form of embodiment disclosed in U.S. Pat. No. 4,048,373, the leakproofing panel is constituted by two corrugated card-board sheets and by a corrugated paper band which is placed between them.

Said paper band comes into contact with the two sheets forming a plurality of voids which are filled with the bentonitic composition mentioned above.

U.S. pat. No. 4,048,373 discloses a water impervious panel comprising one upper and one lower sheets, said sheets being made of one of one of a range of polymers. A shortcoming of the above document is that the dissolution rate is not predetermined and controlled, theref ore there may be found to occur the expansion of the bentonite pack at undesired times, and the only thing that can be relied upon in that respect is carrying out the operations in an extremely expedite way, which is not always possible whereas it is always to the detriment of accuracy and safety, and does not rule out t he risk that the expansion takes place when the panels are still being worked upon.

Moreover, the panel disclosed in the above document is not structurally feasible, as the water swellable material is simply laid upon its solid support, therefore it is prone to structural failure.

In the present application the bulk impermeable material is found to be spread over an inner layer made of biodegradable kraft paper that has characteristically such a shape that it confers the device an overall inherent resilience and resistance, therefore a particular suitability for use in the building industry as there are no risks for it to suffer from structural failures even when the water swellable material has not set.

Furthermore, the dissolution rate of the coating can be controlled with extreme precision.

EP-A-567,692 discloses a clay-based impermeable material to be used in the building industry, made of sodium or calcium bentonite, and applied to a support, said material fulfilling its function on account of the fact that the sodium or calcium bentonite is coated with a degradable and temporarily water resistant coating, made of cellulose. The durability of the coating disclosed in the above document depends on its thickness, as after contact with water, it breaks down at a constant rate. Therefore if a material with a relatively long temporary surface impermeability is desired, then encumbering volumes of the surface coating must be used, thing which in certain cases may turn out to be detrimental for the stability of the whole building, as, after dissolution, free voids are left to bear considerable weights. Another shortcoming of the disclosure of the above document is that because the bentonite is simply laid upon its support, it is inherently of limited resilience and resistance.

In other words, this document does not disclose any means for keeping under control the water-solubility of the material constituting the coating layer of the leakproofing article.

U.S. Pat. No. 4,565,468 discloses a device for providing a moisture impervient barrier comprising a base sheet member with a bentonite layer on its upper surface, and a top sheet member positioned over the bentonite.

The top sheet member is constituted of a material pervious to water so as to permit hydration of the bentonite.

The present invention aims to solve the problem constituted by a quick, premature and uncontrollable hydration undergone by granular sodium bentonite when it contacts water, which can be rain water and/or water coming from a water-bearing stratum or from concrete, during particular structure building steps.

Said casual and premature bentonite hydration is often extremely negative as regards to the final result of the structure which has to be built and to the realization of an effective leakproofing barrier.

In fact, if the bentonite hydration process occurs before the concrete structure is laid, and the obtained structure can result as being defective; the consequent effects deriving therefrom can be deleterious for the building.

On the other hand, if the bentonite hydration occurs when the concrete has just been cast, the increase in the bentonite volume can exert a harmful pressure on the concrete which does not have a sufficiently high mechanical resistence yet, thereby causing permanent damages to the building structure.

Furthermore, it may happen that the hydrate bentonite, i.e. the expanded bentonite, soils and muddies the concrete reinforcements causing adhesion problems which determine the iron being uncoupled from the concrete, which phenomenon is known under the name of reduction or zero setting of the iron/concrete matrix.

Thus, said drawbacks produce remarkable and often irreversible damages both to the leakproofing system and to the structure which has to be built.

This means that works must be stopped and a new leakproofing barrier made of bentonite is needed to be laid, thereby causing a loss of time and an increase of the costs.

The realization of water-soluble plastic and completely biodegradable films, e.g. films based on polyvinylic alcohol (PVOH), to be used in very different applications, is also known in the art.

For instance, said articles can be advantageously used as protective colloids of numerous chemical components, particularly in paper and textile fields; as light polarizing filters; as temporary sizes in textile yarns production; as main components in the production of the envelopes of medicinal capsules; as supports for photosensitive elements of television screens.

DESCRIPTION OF THE INVENTION

The present invention aims to set aside the disadvantages and drawbacks which are typical of the background art and to provide for a suitable leakproofing article to be used both in the building of the foundation of habitation and/or factory structures, and in the realization of complex works, such as tunnels, submarine structures and the like.

This is obtained by means of a leakproofing article having the features disclosed in claim 1.

The dependent claims describe particularly advantageous forms of embodiment of the leakproofing article according to the present invention.

The present invention allows to produce a leakproofing article of any suitable shape and dimensions according to any specific need, the leakproofing function being carried out, for instance, by means of granular sodium bentonite acting as active leakproofing element.

According to the present invention, the granular sodium bentonite is introduced into a specific envelope constituted by a film made of water-soluble material, said film being able to delay the start of the bentonite hydration process for a suitably long time which is previously fixed on the base of particular building requirements.

The leakproofing effect described above is advantageously achieved by using bentonite and/or bentonitic compositions, but any other leakproofing material can be used to carry out the present invention.

According to a further form of embodiment, ion exchange resins and/or colloid modifiers, e.g. carboxymethylcellulose, can advantageously be mixed to said leakproofing article.

According to the present invention, the bentonite or the bentonitic composition, used to obtain a leakproofing barrier, becomes insensitive to rain water and/or water-bearing stratum permeations and/or to the water coming from the concrete for the period of time which is needed for laying the leakproofing barrier and for carrying out the subsequent concrete casting operation, thereby avoiding the drawbacks cited above.

Said temporary imperviousness to water is obtained by coating the bentonite with a film made of water-soluble material, said film being able to shield the bentonite from water for a predetermined period of time (for instance from 1 up to 30 days after the occured contact with water).

In such a way the bentonite hydration process, and the consequent activation of the leakproofing effect, can occur in the most suitable instant of time, thereby avoiding damages to the building structure so that the effectiveness of the leakproofing barrier is not compromised.

According to the present invention a water-soluble film advantageously usable to achieve the above-cited object of the invention is constituted by an article known under the trademark HYDROLENEO LTF, produced by IDROPLAST S.p.A., Italy.

HYDROLENE® LTF is a water-soluble and biodegradable film with a thermoplastic composition consisting of about 75% of polyvinylalcohol at high molecular weight and average hydrolysis degree (86–88%), while the remaining 25% consists of polyoilic plasticizers and process additives, notably of organic nature.

Generally, said plasticizers are aliphatic high-boiling polyoils selected from the group comprising natural or synthetic alcohols and/or alcohol-ethers containing at least three carbon atoms per molecule and at least two primary or secondary alcoholic functional groups.

HYDROLENE® LTF water-solubility is controlled by acting on a plurality of parameters.

First of all, it is necessary to remark that the HYDROLENE® LTF water-solubility rate strongly depends on the temperature of the water contacting it.

For instance, FIG. 4 shows the flow of the water-solubility rate with respect to the temperature in the case of a type of HYDROLENE® LTF.

This curve points out a particular temperature value, called WST temperature (Water Solubility Temperature), which divides the graph into two distinct zones (zone A and zone B), said value representing the temperature at which HYDROLENE® LTF completely solubilizes in water.

As it is shown in FIG. 4, the HYDROLENE® LTF water-solubility rate increases very slowly with the temperature in zone A; on the contrary, when the WST value is reached, the curve passes from zone A to zone B where the HYDROLENE® LTF water-solubility rate quickly increases with temperature.

A curve similar to that of FIG. 4 can be obtained taking into consideration the HYDROLENE® LTF water-solubility rate compared to time.

Thus, when both the water temperature and the period of time after which the hydration have to occur are fixed, to keep working inside of zone A it is necessary to modify the chemical formulation of HYDROLENE® LTF by using plasticizers and/or shield agents, even combined together.

In fact, said components retain the oxydrilic groups of the polyvinylalcohol allowing the starting time of the polymeric chains breaking reaction to be controlled, while the temperature controls the reaction kinetics.

In order to keep working in zone A, a suitable plasticizer in a given quantity (e.g., on the base of its viscosity and its binding properties), as well as a suitable shielding agent have to be selected.

Furthermore, having defined with (1)

$$—(CH2–CHOH)n—(CH2–CHOCOCH3)m— \quad (1)$$

a generic formulation of a polyvinylalcohol obtained by a controlled hydrolysis of the polyvinylacetate, in which formulation n indicates the alcoholic groups and m indicates the acethylic groups, it is possible to control the water-solubility of said polyvinylalcohol, remarkably lowering it, by using alcohols having n/m rate values higher than 95/5.

Other water-soluble articles based on polyethylene, polycaprolactone, maize amid and other articles similar to HYDROLENE® LTF, i.e. having a polyvinylalcoholic base, can be used as envelopes for the leakproofing material.

As said before, the leakproofing article according to the present invention can be obtained in different dimensions, thicknesses and shapes in order to be suitable for any building type and requirement.

According to a first form of embodiment, said leakproofing article has a panel-like shape having standard dimensions in accordance with the specific use it is addressed to.

Said panel it is constituted by an inner layer, advantageously made of biodegradable kraft paper having a honeycomb shape in order to contain the bentonite and/or the bentonitic composition and to maintain it uniformly distributed on the whole panel surface.

This uniformity is very important since the granular sodium bentonite is characterized by a very variable granulometry which requires a given weight for square meter dosage of the bentonite (e.g. $Kg/m^2$) in order to obtain a gel omogeneously distributed on the whole surface to be made impervious to water when the hydration process has occured.

Said gel should advantageously be distributed on the surface to be made impervious as uniformly as possible; actually, thanks to a complete and immediate adhesion to the concrete, it determines the formation of a gel/concrete matrix which prevents a migration of water to the concrete/leakproofing interface.

Moreover, if a mistake occurs during the laying operation of the barrier, or in the case where fissures are formed in the concrete, the gel adhesion to the concrete allows the point where the loss has occured to be exactly singled out, and in this way it is possible to quickly and efficiently operate in a simple and safe way on the damaged area.

The weight dosage of the bentonite allows granular sodium bentonite to be used, having any granulometric distribution.

Thus, in a simple and precise way it is possible to obtain leakproofing articles having a different total permeability rate (K) since, using a bentonite of the same quality, said rate is proportional to the bentonite weight for each square meter of surface to be made impervious to water.

Besides, it is also possible to obtain articles having a different thickness on the base of the bentonite quantity which is used, thereby realizing articles having a suitable permeability relative to the specific hydraulic gradient.

Furthermore, the inner layer honey-comb structure of this panel-shaped form of embodiment allows the bentonite to be kept uniformly distributed when the panel is vertically placed or during its transport and/or when assemblying the leakproofing barrier.

Moreover, the honey-comb structure gives the panel the necessary mechanical strength for being used.

Furthermore, said inner layer is wrapped on both sides by means of a water-soluble plastic film which is suitably formulated and treated so as, once it contacts water at ambient temperature, said film dissolves after a predetermined period of time on the base of the characteristic average technical times of any building structure.

Said water-soluble plastic films are finally coupled, for protection purposes, to a mechanical reinforcement element which is respectively made of non-woven fabric on the dry side directed to the surface to be made impervious, and in biodegradable kraft paper or in thermoformed non-woven fabric on the side which directly contacts the external environment.

The layer which is placed on the dry side, and thus directed towards the surface to be made impervious, is advantageously made of thermoformed non-woven fabric based on low molecular weight polyester, and has a suitable open structure in order to allow the passage of the hydrated bentonite, i.e. the bentonite in its gel phase.

According to a further form of embodiment, said layer made of non-woven fabric can be replaced by a fabric layer having suitable weft, warping and weight.

Said gel, passing through said non-woven fabric and permanently burying the latter, realizes in this way the structure/leakproofing matrix cited above.

Moreover, said layer gives the underlying water-soluble film a mechanical protection, notably during the panel transport and/or assemblying operations.

According to the present invention the layers constituting the panel are advantageously joined together by using a water-soluble glue having physical-chemical characteristics which are equivalent to those of the water-soluble plastic film wrapping the honey-comb shaped inner layer.

Furthermore, it is possible to realize the coupling of the layers constituting the panel by using non water-soluble glues provided that they are not continuously and uniformly spread.

This means that the non water-soluble glue layer must be distributed in such a way as to leave some free areas on the surface interested to the glueing operation, said free areas allowing the passage of the water and of the bentonite as disclosed above.

When said layers are superimposed to each other according to the cited sequence, the panel is then completed by sealing the longitudinal and cross edges of the water-soluble plastic films by thermal welding and/or glueing by means of water-soluble and/or non water-soluble glues.

The panel-shaped form of embodiment according to the present invention is particularly used as leakproofing barrier in building of underground structures, tunnels and any other complex structures, such as submarine works.

Said panels can also have different shapes, they do not compulsory show a square cross-section, and they can also be very long (up to a hundred meters or more).

A further form of embodiment of the present invention provides for a article having a kerb or bead shape, which is particularly suitable for the impermeabilization of casting shut joints.

According to said form of embodiment, pure bentonite and/or bentonitic composition and/or any other leakproofing material in powder form and/or as a mixture, is filled inside of an envelope which advantageously has a cylindrical shape.

Said envelope is made of water-soluble plastic material which is leakproofing for a predetermined period of time as previously described with reference to the panel-shaped form of embodiment.

These envelopes can be made of different and specific dimensions according to the different building and/or application needs, and they are then produced in small dimensions (generally not longer than one meter), or wrapped in rolls up to some meters long.

Said kerbs are cheap and easy to be placed, e.g. by using fastening elements made of thermoformable plastic material or of electric welded metallic nets.

ILLUSTRATION OF THE DRAWINGS

Other features and advantages of the present invention will become apparent by reading the following description, given as a non-limiting example, with the help of the figures illustrated in the attached drawings, in which:

FIG. 3 shows a method for fastening an article according to the form of embodiment of FIG. 2.

FIG. 4 shows a graphical representation.

DESCRIPTION OF A FORM OF EMBODIMENT

Figure 1:
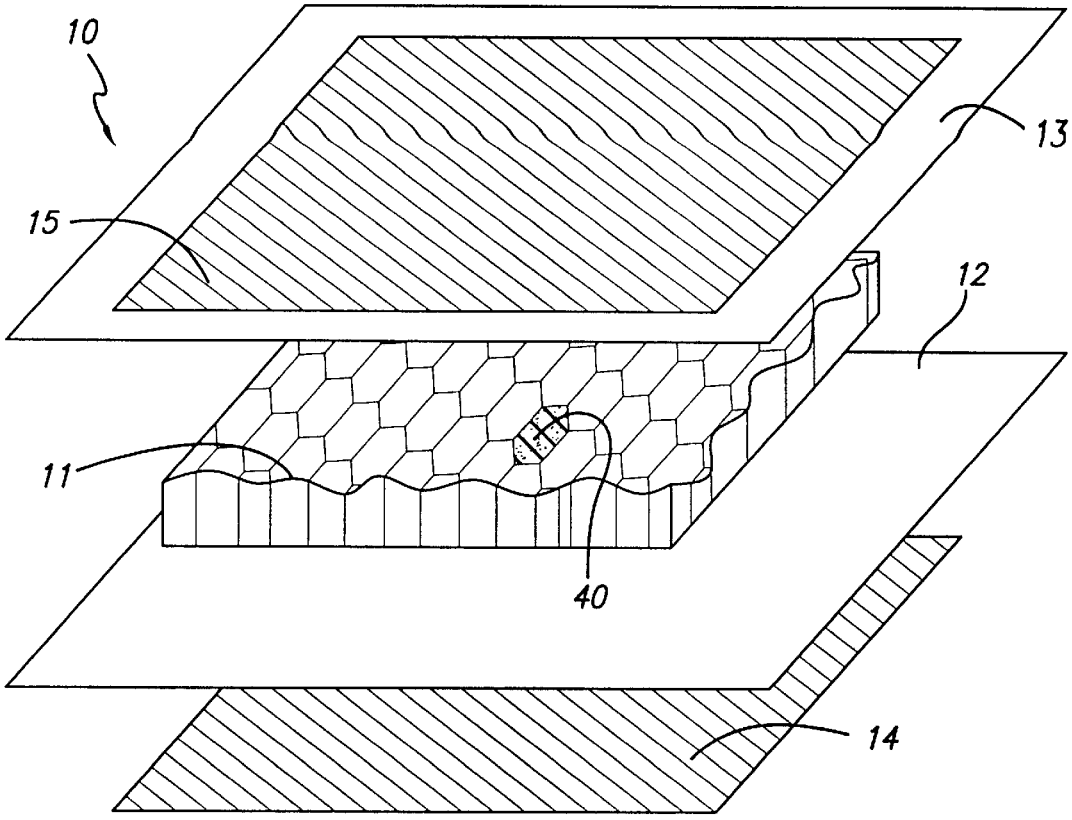
FIG. 1 shows a schematic section view of a first form of embodiment of the article according to the present invention.

In FIG. 1, reference sign 10 indicates a leakproofing article according to a first form of embodiment of the invention, in which said article has the shape of a panel.

Said panel is constituted by an inner layer 11 made of biodegradable kraft paper and having a honey-comb shape in order to contain and keep uniformly distributed a material 40, advantageously bentonite, on the whole panel surface.

Moreover, said honey-comb shape of the inner layer 11 allows the bentonite to be kept uniformly distributed also when the panel is vertically placed or during its transport and/or assemblying operations.

Said shape also confers to the panel the necessary mechanical strength in order to assure a sufficient rigidity in use.

Besides, said inner layer 11 is wrapped on both sides by means of a film the water-solubility of which is kept under control, said film being advantageously constituted by HYDROLENE® LTF 12 and 13, which dissolves when contacting water only after a predetermined period of time which is predetermined on the base of the type of structure to be built.

Said films 12 and 13 are coupled, for protection purposes, to a mechanical reinforcement element which is respectively made of either non-woven fabric or fabric 14, on the dry side directed to the surface to be made impervious to water, and of biodegradable kraft paper 15 on the side which directly contacts the external environment.

The layer 14 is made of thermoformed non-woven fabric, constituted by low molecular weight polyester, and it has an open structure in order to allow the passage of the bentonite during its gel phase.

In fact, said gel, once it is passed through the layer 14 which will permanently be buried in the gel, is able to adhere to the structure which has to be made impervious to water, thereby realizing a structure/leakproofing matrix which prevents the migration of water to the concrete/leakproofing interface.

Moreover, the layer 14 gives a mechanical protection to the underlying water-soluble film 12, notably during the panel transport and/or assemblying operations.

According to the present invention the layers constituting the panel 10 are joined together either by using a water-soluble glue having physical-chemical characteristics equivalent to those of films 12 and 13, or by using a non water-soluble glue, provided that in this case said non water-soluble glue is not uniformly distributed on the panel surface.

Once said layers 11, 12, 13, 14 and 15 are superimposed to each other according to the above mentioned sequence, the panel 10 is completed by sealing the longitudinal and cross edges of the films 12 and 13 by thermic welding or by glueing by means of water-soluble and/or non water-soluble glues, thereby obtaining a handy panel which can be easily and efficiently laid.

Figure 2:
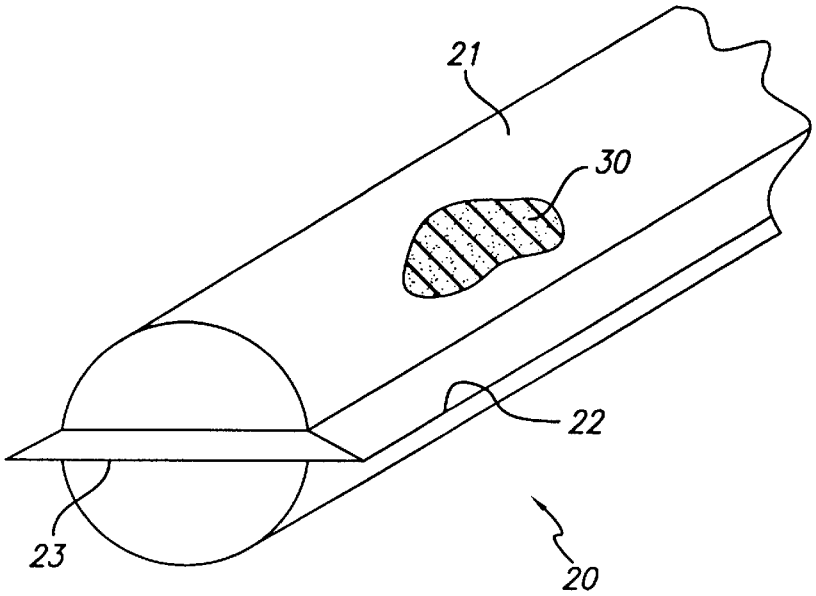
FIG. 2 shows a second form of embodiment of the article according to the present invention.

A further form of embodiment according to the present invention provides for the production of said leakproofing article in a kerb shape 20 (see FIG. 2), according to which pure bentonite in powder form 30 is filled inside of an envelope 21 of cylindrical shape having a diameter advantageously lower than 4 cm.

According to a form of embodiment of the invention, the bentonite is used as powder and it has to be considered pure since it does not contain any physical binders or mixtures.

Said envelope 21 is produced in water-soluble plastic material, advantageously HYDROLENE® LTF, and has the capability to be leakproofing for a predetermined period of time in order to suitably delay the bentonite hydration process.

The longitudinal 22 and cross 23 edges of the plastic material constituting the envelope 21 are coupled and joined together by thermal welding, exactly in the same way as it occurs for the panel-shaped form of embodiment 10.

Said kerb 20 can be easily laid in use by means of an assemblying and fastening element 24 (see FIG. 3), said element being advantageously made of thermoformable plastic material and having a fastening side surface 25.

The fastening operation can be easily realized using nails or rivets 26 operating on the fastening surface 25.

Generally, said assemblying element 24 is constituted by an extruded polyethylene grate of a prefixed length in order to allow a practical and safe introduction of the kerb 20 inside of the reinforcement element of the building structure.

The invention has been previously described with reference to some particular forms of embodiment.

However, it is apparent that the invention is not limited to these forms of embodiment, but it comprises several variants falling within the range of technical equivalences, as defined by the appended claims.

For instance, it is possible to produce a panel comprising a corrugated card-board which is filled with a leakproofing material, advantageously bentonite, said cardboard being coated on both sides by kraft paper, said kraft paper being then coated by a film made of a synthetic material the water-solubility of which is kept under control, said film being finally coated with a kraft paper layer on both sides or with a kraft paper layer on the outer side and with a non-woven fabric and/or fabric layer on the side which directly comes into contact with the structure to be made impervious to water.

What is claimed is:

1. A manufactured article impervious to water, to be used in the building industry, comprising a water swellable bentonite layer, said water swellable bentonite layer is covered with a plastic film said plastic film being made of approximately 75% by weight polyvinylalcohol polymer mixed with approximately 25% by weight polyolic plasticisers and additives, wherein said polyolic plasticisers are aliphatic, high boiling point and are selected among those comprising natural or synthetic alcohols and/or alcohol ethers with three carbon atoms in their structures, at least two primary or secondary alcoholic functional groups, said plastic film being water soluble and taking a predetermined period of time to dissolve, said period of time being in the range between 1 and 30 days.

2. A manufactured article according to claim 1, wherein said article is shaped as a panel.

3. A manufactured article according to claim 2, wherein said panel comprises an inner layer made of biodegradable kraft paper and having a honey-comb shape in order to contain said bentonite layer, said inner layer being coupled on both sides to said plastic film.

4. A manufactured article according to anyone of claims 1, 2 or 3, wherein said film is further coupled to a protecting layer made of fabric and/or biodegradable kraft paper.

5. A manufactured article according to anyone of claims 1, 2 or 3, wherein the solubility of the polyvinylalcohol decreases when the ratio between the alcohol groups and the acetyl groups in the polymer is higher than 95/5.

6. A manufactured article according to anyone of claims 1, 2 or 3, wherein the layers constituting said article are joined together by glueing.

7. A manufactured article according to claim 6, wherein the used glue is water-soluble.

8. A manufactured article according to anyone of 1, 2 or 3, wherein longitudinal and cross edges of said film are sealed by thermal welding and/or glueing.

9. A manufactured article according to claim 1, wherein said article is kerb shaped.

10. A manufactured article according to claim 9, wherein said kerb comprises a cylindrical envelope made of said plastic film, wherein said envelope contains said bentonite layer.

11. A manufactured article according to anyone of claims 9 or 10, wherein said kerb is laid by means of fastening elements made of thermoformable plastic material.

12. A manufactured article according to anyone of claims 9 or 10, wherein said kerb has a diameter equal or lower than 4 cm.

13. A manufactured article impervious to water, to be used in the building industry, comprising a water swellable bentonite layer, said water swellable bentonite layer is covered with a plastic film, said plastic film being made of approximately 75% by weight polyvinylalcohol polymer mixed with approximately 25% by weight polyolic plasticisers and additives, the polyvinyl alcohol having a high molecular weight and an average hydrolysis degree greater than about 80%, said film being water soluble and taking a predetermined period of time to dissolve, said period of time being in the range between 1 and 30 days.

14. A manufactured article as claimed in claim 13 wherein at least one of the polyvinyl alcoholic polymers or polyolic platicisers and additives comprises natural or synthetic alcohols and/or alcohol ethers with at least three carbon atoms and two primary or secondary alcoholic functional groups, and wherein the polyolic plasticiser has a aliphatic high boiling point.

15. A manufactured article impervious to water, to be used in the building industry, comprising a water swellable bentonite layer, said water swellable bentonite layer is covered with a plastic film, said plastic film being made of approximately 75% by weight polyvinylalcohol polymer mixed with approximately 25% by weight polyolic plasticisers and additives, wherein the ethynol/acetile monomer ratio in the polyvinyl alcohol is selected such that said film is water soluble and takes a predetermined period of time to dissolve, said period of time being in the range between 1 and 30 days.

16. A manufactured article impervious to water, to be used in the building industry, comprising a water swellable bentonite layer, said water swellable bentonite layer is covered with a water soluble plastic film, said plastic film being made of approximately 75% by weight polyvinylalcohol polymer mixed with approximately 25% by weight polyolic plasticisers and additives, wherein the solubility rate is determined on the ratio of the amount of the alcohol group to the amount of acetile group in the polymer such that said film takes a predetermined period of time to dissolve, said period of time being in the range between 1 and 30 days.

17. A manufactured article according to claims 13, 14, 15 or 16, wherein said article further comprises an inner layer made of biodegradable kraft paper and having a honey-comb shape in order to contain said bentonite layer, said inner layer being coupled on both sides to said plastic film.

* * * * *